United States Patent [19]

Parker

[11] Patent Number: 4,741,937

[45] Date of Patent: May 3, 1988

[54] FIRE RESISTANT TRASH CONTAINERS AND METHOD

[76] Inventor: Bruce H. Parker, 25543 Avenida Frasca, Valencia, Calif. 91355

[21] Appl. No.: 40,184

[22] Filed: Apr. 17, 1987

Related U.S. Application Data

[63] Continuation of Ser. No. 794,075, Nov. 1, 1985, abandoned.

[51] Int. Cl.[4] ..... B65D 90/02

[52] U.S. Cl. ..... 428/35; 220/1 T; 428/920

[58] Field of Search ..... 428/35, 323, 331, 920, 428/921; 220/1 T, 88 R, 454; 215/1 C; 252/601, 609

[56] References Cited

U.S. PATENT DOCUMENTS

| | | | |
|---|---|---|---|
| 3,082,185 | 3/1963 | Doedens | 252/609 |
| 3,135,419 | 6/1964 | Bulmer | 220/88 R |
| 3,434,588 | 3/1969 | Kirkpatrick | 206/46 |
| 4,130,538 | 12/1978 | Shutt | 529/405 |
| 4,445,623 | 5/1984 | Kolling et al. | 220/1 T |
| 4,544,695 | 10/1985 | Myers | 524/405 |
| 4,615,454 | 10/1986 | Verhoog, Jr. | 220/1 T |

*Primary Examiner*—Nancy A. B. Swisher
*Assistant Examiner*—James J. Seidleck
*Attorney, Agent, or Firm*—Louis J. Bachand

[57] ABSTRACT

A fire resistant plastic trash container is provided by embedding a contiguous mass of incombustible particulate in the container surfaces to be protected, suitably by gravity impact during rotational molding of the container.

10 Claims, 1 Drawing Sheet

FIRE RESISTANT TRASH CONTAINERS AND METHOD

This application is a continuation of application Ser. No. 794,075 filed Nov. 1,1985, now abandoned.

TECHNICAL FIELD

This invention has to do with improvements in trash containers such as are used for the collection of municipal trash by automated means, and more particularly is concerned with making synthetic organic polymeric trash containers, e.g. those formed of cross-linked polyethylene by rotomolding processes, sufficiently fire resistant to retard combustion of the plastic despite a fire in the trash contents within the container.

BACKGROUND OF THE INVENTION

Large molded plastic trash containers in sizes ranging from 90 to 440 gallon are becoming increasingly used by municipalities in automated trash collection systems where these containers are lifted by hydraulic arms operated from the sides of collection trucks. These containers are replacing the old style metal containers. It is desirable to minimize the risk of the containers burning as a result of a fire in their trash contents. One approach is to make the containers out of fire-resistant materials, but these are very expensive. Another approach is to make the containers out of the usual cross-linked polyethylene material, and laminate a relatively thin sheet of fire-resistant material to the container interior. While this reduces material cost somewhat over the first approach, available materials tend to delaminate over time and are quite brittle, requiring special handling of the containers which is fairly impractical to achieve on trash collection routes.

SUMMARY OF THE INVENTION

It is accordingly an object of this invention to provide an improved trash container. It is another object to provide a plastic trash container which is fire resistant. Still another object is to provide a trash container which uses commonly available mineral material embedded in the container wall to decrease the combustability of the plastic by displacing a substantial portion of the combustible plastic in the surface and which screens the plastic as well from flame and heat. Still another object is to provide method of forming such containers, typically by a modification of the rotational molding process whereby sand or like particulate is introduced into the mold after wall formation initiation but before final wall formation, so that the sand or other particulate is embedded in the wall surface by gravity impaction and further formation of the wall onto the particulate.

These and other objects of the invention to become apparent hereinafter are realized in a fire resistant trash container having a generally planar bottom wall, an axially elongated side wall defining a closed figure with the bottom wall, and a closable opening at the upper end of the side wall, the container walls being formed of synthetic organic plastic having a tendency to burn under persistent exposure to direct flame, and means increasing the first resistance of the walls to such exposure, the means comprising a substantially continuous extend of finely divided, incombustible particulate embedded in the wall surfaces to be protected.

In particular embodiments, the particulate is mineral, the constituent particles of the particulate are distributed over the extent in contiguous relation, the particulate extends both inwardly into the container wall to be protected and outwardly therefrom, the particulate typically being embedded in the container wall to be protected while the wall is soft from heat, and there is further contemplated overcoating the embedded particulate with a fire resistant coating over the particulate, of organic or inorganic film-forming nature such as a paint, a glass liner or the like.

In particularly preferred form, the invention provides a fire resistant trash container having a generally planar bottom wall, an axially elongated side wall defining a closed figure with the bottom wall, and a closable opening at the upper end of the side wall, the container walls being formed of synthetic organic crosslinked polyethylene plastic having a tendency to burn under persistent exposure to direct flame, and means increasing the fire resistance of the walls to such exposure, the means comprising a substantially continuous extend of finely divided, incombustible particulate embedded in the wall surfaces to be protected.

In this embodiment the preferred particulate is sand, the constituent particles of the sand being distributed over the extent in contiguous relation, the sand particulate extending both inwardly into the container wall to be protected and outwardly therefrom, the sand particulate being embedded in the container wall to be protected while the wall is being heat-formed, and including also a fire resistant coating over the sand particulate.

In a further embodiment, there is provided a fire resistant trash container comprising an upwardly open crosslinked polyethylene receptacle, and a layer of sand interspersed through the interior surface of the receptacle in fire propagation blocking relation at the surface.

The invention further contemplates the method of increasing the fire resistance of trash containers including embedding finely divided, incombustible particulate in the surfaces of the container to be made fire resistant, e.g. embedding the particulate while the container surface is heated to softness, ballistically impacting the particulate against the soft container in a heated state with the particulate therewithin, and embedding the particulate with the force of the particulate falling across the volume of the container, and in a most particularly preferred embodiment, rotating powdered resin in a heated mold to form the container, and embedding the particulate in the formed but not fully formed container wall before completion of the molding cycle.

THE DRAWING

The invention will be described as to an illustrative embodiment in conjunction with the attached drawings in which.

PREFERRED MODE

As will be noted from the foregoing, the invention provides an incombustible particulate incorporated into the surface of the trash container where there is likelihood of fire exposure. In tests it has been found that a propane torch will not ignite a crosslinked polyethylene container wall in which sand has been embedded to the extent of covering the surface with contiguous sand particles of a size and distribution like that of 300 grit sandpaper. In general, a coherent covering of sand is not required, provided the surface is embedded with the sand to the degree that all portions of the substrate are sand particle receiving, the particles being in shoulder to shoulder contact in generally all lateral directions, for which condition the description and claims herein use the term "contiguous". Other incombustible particulates can be used, e.g. diatomaceous earth, talc, glass, asbestos, and other mineral substances which are incombustible at expectable fire temperatures, i.e. temperatures less than 600° F. and available as finely divided particles, e.g. from 100 to 350 U.S. mesh or more or less, provided such can be embedded in the container wall, maintain its integrity in the wall under fire conditions and act as a heat sink and diluent for the resin matrix so as to impede fire propagation. Such materials as BC or ABC Powder, the component of dry fire extinguishers which is believed to be river bed dust having a silica component to be free flowing, and Fuller's earth can also be used. The container wall material is not narrowly critical, but crosslinked polyethylene is the most widely used molding material and is preferred herein for its low cost and its effectiveness when surface modified in accordance with the invention. While not required, a further surface coating may be used, e.g to smooth the container interior for ease of trash emptying, or to simply dress the interior. Fire proof lacquers, and glass coatings or resinous materials of known fire-resistant quality may be used for this purpose if film forming or fusible onto the surface of the container in adhering relation (the presence of the sand or other polar mineral particulate aids in adhesion) so as to cover or partly cover the embedded particulate protuberances.

Figure 1:
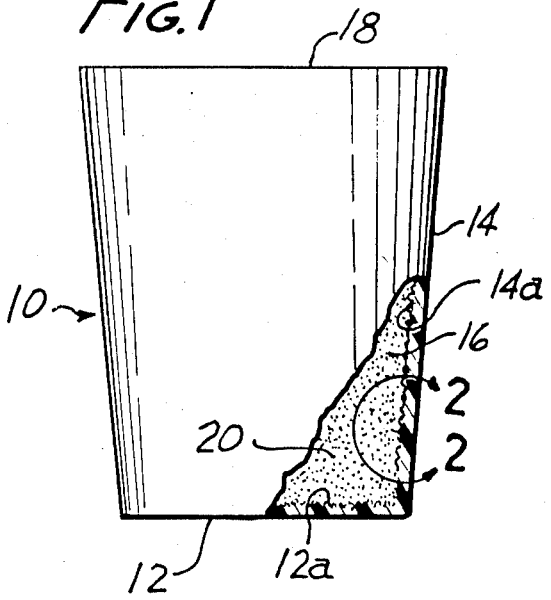
FIG. 1 is an elevational view partly in section of a container according to the invention.
Figure 2:
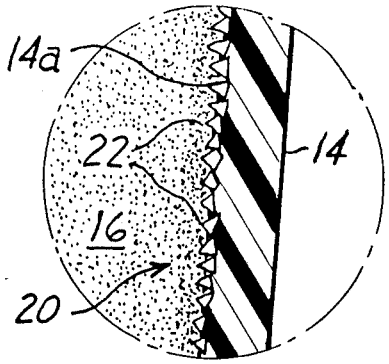
FIG. 2 is a view taken on line 2—2 in FIG. 1 and enlarged.

With reference now to the drawing in detail, in FIGS. 1 and 2, the fire resistant trash container is shown at 10, having a generally planar bottom wall 12, an axially elongated side wall 14 defining a closed figure volume 16 with the bottom wall, and a closable opening 18 at the upper end of the side wall. The container walls are formed of synthetic organic plastic having a tendency to burn under persistent exposure to direct flame, and accordingly means increasing the fire resistance of the walls to such exposure is provided comprising a substantially continuous extent 20 of finely divided, incombustible particulate embedded in the wall surface 12*a*, 14*a* to be protected.

The constituent particles 22 of the particulate are distributed over said extent 20 in contiguous relation as shown. In addition, and also as shown in FIG. 2, the constituent particles 22 extend both inwardly into said container wall 14*a* to be protected and outwardly therefrom, a condition which is achievable if either the particulate 22 and or the surface 14*a* is hot enough for the particles to enter the wall surface with the impact force available, preferably the wall 14 is soft at the time of impact.

Figure 3:
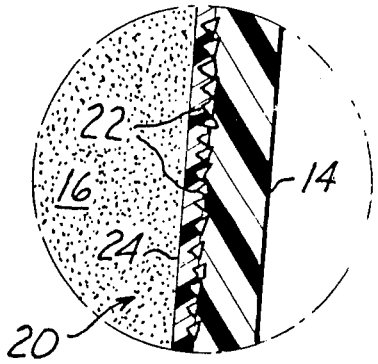
FIG. 3 is a view like FIG. 2 of an alternate embodiment.

In certain embodiments, illustrated in FIG. 3, a fire resistant coating 24 is provided over the protruding particles 22. Where sand is used as particles 22, barbecue paint can be effectively used over the particles to diminish roughness and maintain fire resistance.

Figure 4:
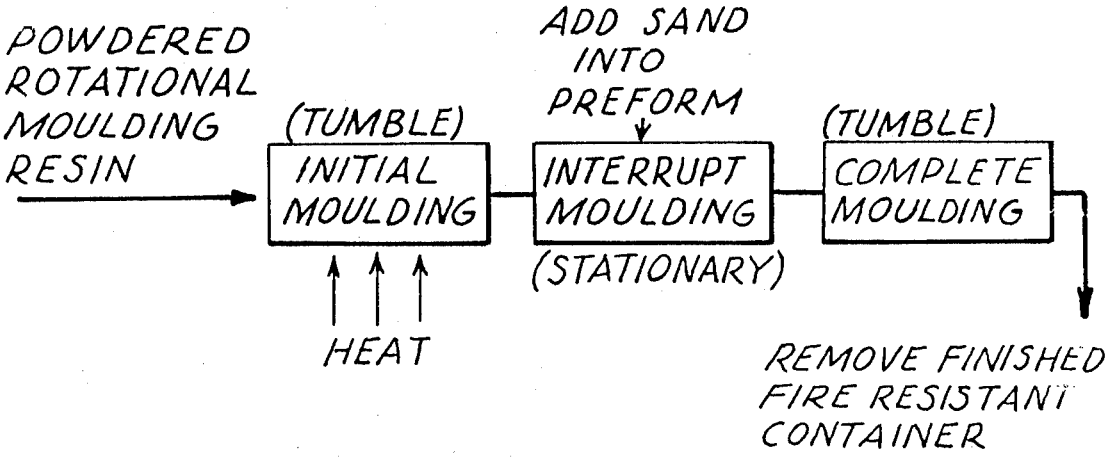
FIG. 4 is a schematic of the molding method.

With particular reference now to FIG. 4, the preparation of the fire resistant trash container 10 according to the invention in a preferred method is outlined. The upwardly open crosslinked polyethylene receptacle is first partly formed by adding powdered rotational molding resin having a contained crosslinking agent to a mold cavity capable of multiangled rotation with heat, as is typical with rotational molding processes. After initiation of the molding cycle, the powdered resin begins to fuse at the heated mold cavity surfaces and form an integral wall member which eventually is to be walls 12 and 14 of the container 10. At the stage where the container wall is formed but soft and not completely formed, the cycle is briefly interrupted for the purpose of adding to the interior of the semi-formed container the particulate to be incorporated in the container walls. This can be done by opening a hatch in the mold wall and pouring the sand in. Rotation of the mold resumes. The sand or other particulate falls across the volume of the container as the mold tumbles through its pattern of movement, impacting the soft wall of the container with ballistic force and added force from the weight of the sand behind the surface contacting particles. As a result, the sand particles become embedded. At the same time, the powdered resin remaining in the mold at the point of cycle interruption, if any, continues to build up on and around the embedding particles further solidifying their positioning. The revolving nature of the illustrative molding process ensures universal coverage of the container interior, unless portions have been masked off or been relatively hardened, with the particulate. The container is removed after molding is completed, and coated if desired.

The nature of the particulate extent of fire resistant material is that of a surface and subsurface incorporation of particles which largely displace the original surface material by filling it to the exclusion of the resin virtually, except as needed to support the particles. Because the action of the sand particulate is largely mechanical, no narrow ratios of weight of sand to weight of resin can be stated, it being necessary only to develop a fire barrier layer of the sand in the surface by having sufficient sand particles to cover the surface one to several particles deep, so that the particles are contiguous whether in a single or adjacent multiple planes.

I claim:

1. Fire resistant trash container having a generally planar bottom wall, an axially elongated side wall defining a closed figure with the bottom wall, and a closable opening at the upper end of the side wall, said container walls being formed of synthetic organic plastic having a tendency to burn under persistant exposure to direct flame, and means increasing the fire resistance of said walls to such exposure, said means comprising a substantially continuous extend of finely divided, incombustible particulate embedded ballistically in the wall surfaces to be protected while such surfaces are heated to softness during formation of said container.

2. The fire resistant trash container according to claim 1, in which said particluate is mineral.

3. The fire resistant trash container according to claim 1, in which the constituent particles of said particulate are distributed over said extent in contiguous relation.

4. The fire resistant trash container according to claim 1, in which said particulate extends both inwardly into said container wall to be protected and outwardly therefrom.

5. The fire resistant trash container according to claim 1, including also a fire resistant coating over said particulate.

6. Fire resistant trash container having a generally planar bottom wall, an axially elongated side wall defining a closed figure with the bottom wall, and a closable opening at the upper end of the side wall, said container walls being rotationally molded from a powder of synthetic organic crosslinkable polyethylene plastic having a tendency to burn under persistent exposure to direct flame, and means increasing the fire resistance of said walls to such exposure, said means comprising substantially continuous extent of finely divided, incombustible particulate ballistically embedded in the wall surfaces to be protected by gravity impaction thereof against said wall surfaces during rotational molding of said container and while said wall surfaces are heated to softness.

7. The fire resistant trash container according to clain 6, in which said particulate is sand.

8. The fire resistant trash container according to claim 7, in which the constituent particles of said sand are distributed over said extent in contiguous relation.

9. The fire resistant trash container according to claim 8, in which said sand particulate extends both inwardly into said container wall to be protected and outwardly therefrom.

10. The fire resistant trash container according to claim 9, including also a fire resistant coating over said sand particulate.

* * * * *